United States Patent [19]

Mills

[11] 4,117,822

[45] Oct. 3, 1978

[54] ENGINE PROTECTIVE DEVICE WITH RESTRICTED MANUAL OVERRIDE

[75] Inventor: J. T. Mills, Houston, Tex.

[73] Assignee: Sentinel Distributors, Inc., Denver, Colo.

[21] Appl. No.: 789,884

[22] Filed: Apr. 22, 1977

[51] Int. Cl.[2] ..... F02B 77/08

[52] U.S. Cl. ..... 123/198 DB; 123/41.15; 123/196 S

[58] Field of Search .... 123/198 D, 198 DC, 198 DB, 123/41.15, 196 S

[56] References Cited

U.S. PATENT DOCUMENTS

| | | | |
|---|---|---|---|
| 3,202,143 | 8/1965 | Goodwin | 123/41.15 |
| 3,202,161 | 8/1965 | Richards | 123/198 D X |
| 3,533,390 | 10/1970 | Goodwin | 123/198 DB |
| 3,590,798 | 7/1971 | Goodwin | 123/198 D |
| 3,877,455 | 4/1975 | Goodwin | 123/198 DB |

*Primary Examiner*—Charles J. Myhre
*Assistant Examiner*—Ira S. Lazarus
*Attorney, Agent, or Firm*—Cameron, Kerkam, Sutton, Stowell & Stowell

[57] ABSTRACT

A safety device for controlling the flow of fuel to an internal combustion engine so as to protect the engine against damage due to insufficient oil pressure in the lubricating system, or to overheating, has a restricted manual override which supplies to the engine, after a full fuel shut-off effecting a full shut-down of the engine when abnormal pressure or temperature conditions arise, a restricted amount of fuel sufficient only to run the engine at a reduced power and at reduced speed so as to prevent damage to the engine which might result were the engine to operate at full speed and full power in the absence of adequate oil pressure, or when overheated.

2 Claims, 5 Drawing Figures

ENGINE PROTECTIVE DEVICE WITH RESTRICTED MANUAL OVERRIDE

BACKGROUND OF THE INVENTION

This invention relates to safety devices for controlling the flow of fuel to internal combustion engines so as to protect an engine against damage due to insufficient oil pressure in the lubricating system thereof or to overheating, and more particularly to protective apparatus for use with gasoline or diesel engines which drive motor vehicles.

There are in the prior art a number of engine protective devices which completely shut off the flow of fuel to the engine in the event of inadequate lubricating oil pressure or overheating, including those disclosed in U.S. Pat. Nos. 3,202,143 and 3,590,798, on which the device of the present invention is an improvement.

The device of U.S. Pat. No. 3,202,143, dated Aug. 24, 1965, is a full fuel shut-off valve effecting an automatic full shut-down of the engine when the oil pressure drops below a predetermined value or the engine overheats, but it also includes a manually operable override which, when operated, will allow sufficient fuel to reach the engine to produce maximum power and speed even though the oil pressure has dropped below normal, or the engine is overheated, with possible consequent damage to the engine.

U.S. Pat. No. 3,590,798, dated July 6, 1971, also discloses an engine safety device responsive to abnormal oil pressure and coolant temperature conditions, but this device is not a full fuel shut-off effecting a full shut-down of the engine, but is an automatic engine decelerating or detorqueing valve by virtue of a built-in fuel by-pass that continues to supply the engine with a restricted quantity of fuel after the main fuel valve is closed. It also includes a manually operated override which, when operated, permits operation of the engine at maximum power and speed, as in the case of the device of U.S. Pat. No. 3,202,143.

It is therefore the object of the present invention to improve upon the engine shut-down devices of the prior art, particularly those of U.S. Pat. Nos. 3,202,143 and 3,590,798, by providing a full fuel shut-off effecting a full shut-down of the engine when abnormal pressure or temperature conditions arise, and a restricted manual override which will minimize or prohibit abuse of a failing engine by disallowing maximum power and speed after the automatic shut-down. This improvement is particularly beneficial in vehicular applications wherein, after automatic shut-down, the driver of the vehicle gets out, engages the manual override, and restarts the engine, but cannot move the vehicle and its load except at slow speed and low gear.

SUMMARY OF THE INVENTION

The present invention resides in a device for controlling the flow of fuel to an internal combustion engine which is an improvement over those of U.S. Pat. Nos. 3,202,143 and 3,590,798 in that a manual override is provided for supplying only a limited flow of fuel to the engine after the main fuel valve has been automatically closed due to a drop in lubricating oil pressure or an excessive increase in coolant temperature. In the preferred embodiment of the invention, the improvement resides in the provision of an internal bypass passageway around the main fuel valve from the fuel intake chamber to the fuel output chamber of the valve assembly, and a manually operable override which normally closes the bypass passageway, but can be manually operated after the engine has shut down so as to supply a predetermined, restricted amount of fuel to the engine so that it may be operated at reduced power and speed, the manual override including a fuel orifice of preselected size which provides the desired power reduction when the manual override is operated, thereby avoiding damage to the engine.

DESCRIPTION OF THE PREFERRED EMBODIMENT

Figure 1:
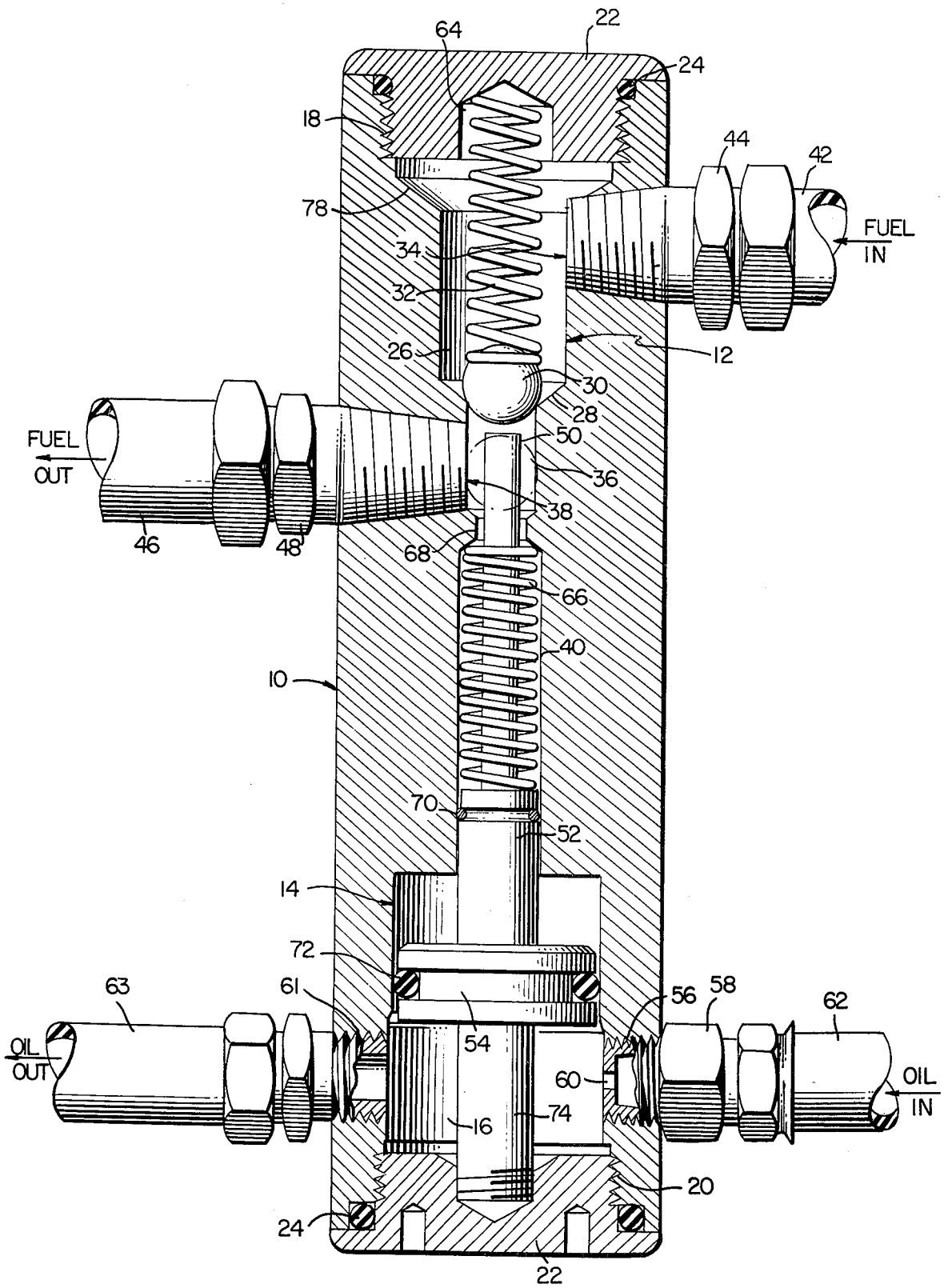
FIG. 1 is a vertical cross-sectional view, with certain parts shown in full, of a device for controlling the flow of fuel to an internal combustion engine embodying an oil pressure controlled, piston-operated, ball-type liquid fuel valve, the valve being shown in its seated or closed position, which device also embodies, as shown in FIGS. 2 and 3, a bypass passageway around the fuel valve, and a manually operable override which normally closes the bypass passageway, but can be manually operated after the engine has shut down so as to supply a predetermined, restricted amount of fuel to the engine.

Referring first to FIG. 1, the device illustrated therein is an oil pressure controlled fuel cut-off valve of construction similar to that illustrated in FIGS. 1–4 of U.S. Pat. No. 3,202,143 which, for convenience, may be referred to hereinafter as an Oil Sentinel, as it was in said prior patent.

As illustrated in FIG. 1 of the patent, when installed on a gasoline or diesel engine, the fuel outlet of the Oil Sentinel is connected to the fuel intake manifold of the engine or intake side of fuel injection pump while its oil inlet is connected to the pressure side of the oil pump of the lubricating system of the engine. Since this form of Oil Sentinel is adapted to be used with a coolant temperature controlled valve, known as a Heat Sentinel, or with both a Heat Sentinel and a coolant pressure control valve, known as a Coolant Flow Pressure Sentinel, as in U.S. Pat. No. 3,877,455, the oil outlet of the Oil Sentinel may be connected to the oil intake of the Heat Sentinel or in parallel to the oil intakes of the Heat Sentinel and the Coolant Flow Pressure Sentinel, and the oil outlets of the latter may be connected to the engine sump.

As shown in FIG. 1, the Oil Sentinel comprises a cylindrical metallic body 10 having an axially extending bore of varying diameter. The upper portion 12 of the bore is somewhat longer and of generally smaller diameter than the lower portion 14 which extends to the lower end of body 10 and forms a chamber 16 of relatively large cross-section. The upper end of bore portion 12 opens into an enlarged counter bore which is of approximately the same diameter as chamber 16 and is provided with internal threads 18. The lower end of chamber 16 is similarly counterbored and provided with internal threads 20 of the same diameter and pitch as threads 18 so that the two ends of body 10 may be closed by a pair of identically threaded caps 22. Each cap 22 is provided with a suitable sealing element 24, such as a rubber or neoprene "0" ring.

The upper portion of the bore designated generally at 12 is further subdivided into three interconnecting shorter length chambers. The uppermost one is a combined fuel intake and fuel valve chamber 26 having at its lower end a tapered or conical valve seat 28 adapted to receive a metallic or rubber ball check valve 30 which is yieldably seated thereon by means of a compression spring 32. Valve body 10 is provided adjacent the upper end with a radially extending threaded fuel inlet port 34 communicating with the chamber 26. Disposed immediately below the fuel intake and valve chamber 26 is an intermediate fuel passage and fuel outlet chamber 36 of less diameter than chamber 26, the body 10 being provided with a radially extending threaded fuel outlet port 38 communicating with the chamber 36. Inlet and outlet ports 34 and 38 are preferably diammetrically aligned in a common vertical plane, but offset horizontally as illustrated. A third chamber 40, forming the lower end of bore portion 12 and serving as a piston chamber as described hereinafter, communicates with both the lower portion of chamber 36 and the enlarged chamber 16 at the lower end of the valve body.

The fuel intake chamber 26 is adapted to receive fuel from a fuel supply tank (not shown) through inlet port 34 and a hose or flexible pipe conduit 42 connected thereto by means of an adapter fitting 44. The fuel is discharged from chamber 36 through outlet port 38 by means of a similar conduit or hose 46 and fitting 48 to the carburetor, intake manifold or fuel injection pump of the engine with which the Oil Sentinel is associated. The flow of fuel from the inlet port 34 to the outlet port 38 through the respective chambers 26 and 36, is controlled primarily by the action of ball valve 30 which is adapted to be moved upwardly to open position by the end portion 50 of an operating piston 52 slidably mounted in the lowermost chamber 40 of bore portion 12 for vertical axial movement therein under the influence of opposing forces as hereinafter described. The ball valve 30 is urged downwardly into closed position on its seat 28 by spring 32 when the piston 52 is at the lower end of its stroke as shown in FIG. 1. The upper end portion 50 of piston 52 is of substantially less diameter than fuel passage chamber 36 so as to permit the free flow of fuel therepast, from the inlet port 34 to the outlet port 38, when the piston is moved upwardly to unseat the ball valve 30.

Connected to the lower end of piston 52 is an enlarged piston head 54 which is slidably mounted in chamber 16 formed by the lower bore portion 14. In order to raise the piston and open valve 30, the lower face of piston head 54 is exposed to the pressure of oil supplied to the chamber 16 by the lubricating oil pump of the engine through an inlet port 56 and an orifice fitting 58 having a restricted orifice 60 of substantially less diameter than the oil inlet port 56, and oil supply conduit 62. Diametrically opposite oil inlet port 56 is an oil outlet port 61 which communicates by means of a suitable conduit 63 with the oil inlet side of the above-mentioned Heat Sentinel, as shown in FIG. 1 of U.S. Pat. No. 3,202,143. The restricted orifice fitting 58 serves to effect a sufficient pressure drop within the oil chamber 16 to effect closing of the valve upon operation of the Heat Sentinel as described in U.S. Pat. No. 3,202,143, or the Coolant Flow Pressure Sentinel as described in U.S. Pat. No. 3,877,455.

In order to yieldably resist the upward valve-opening movement of the ball valve 30 produced by the oil pressure in chamber 16 and to automatically reclose the valve whenever the oil pressure drops below a predetermined value, the compression spring 32 is provided as aforementioned, having its lower end thrusting against the ball valve 30 and its upper end seated in a recess 64 provided in cap member 22. The force exerted on the ball valve 30 may be adjusted by using springs of different strengths.

A second compression spring 66 surrounds the reduced end portion 50 of piston 52, seating at its upper end against a constricted shoulder 68 which divides chambers 36 and 40, and thrusting at its lower end against the operating piston 52. The force exerted on the operating piston 52 may also be adjusted by using springs of different strength. The compression spring 66 serves to positively move the piston 52 downwardly, permitting spring 32 to close the valve, whenever the oil pressure in chamber 16 drops below a predetermined value. Piston 52 and piston head 54 are provided with fuel-and-oil resistant quad ring seals 70 and 72, respectively.

It will be apparent from the foregoing description that the fuel valve 30 will be maintained in an elevated position, permitting a free flow of fuel from inlet port 34 through chambers 26 and 36 to outlet port 38, as long as the oil pressure in the lubricating system of the engine and in said chamber 16 is maintained at or above the predetermined value established by the combined force of springs 32 and 66.

As thus far described, the construction and mode of operation of the Oil Sentinel shown in FIG. 1 are substantially identical with those of the Oil Sentinel of U.S. Pat. No. 3,202,143, except that the device of the present invention does not include any means for manually opening the fuel valve and thereby causing the engine to operate at full power and speed, corresponding to the eccentric cam, shaft and operating handle of said patent. Instead, a piston stop pin 74 is secured into the lower cap 22 and extends upwardly so as to abut the bottom surface of piston head 54 when ball valve 30 has been moved downwardly onto its seat 28 by the pressure of spring 32 so as to shut off the flow of fuel from chamber 26 to chamber 36.

Figure 2:
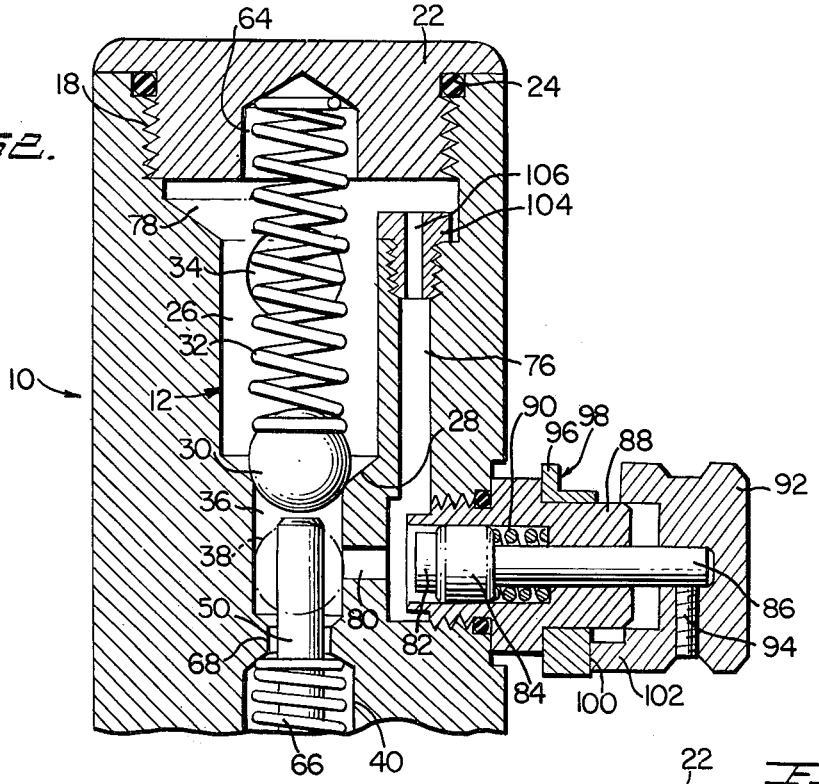
FIGS. 2 and 3 are fragmentary vertical cross-sectional views, with certain parts shown in full, of the upper portion of the device shown in FIG. 1, taken on a plane at right angles to the plane of FIG. 1, showing the manually operable override in position to open the bypass passageway (FIG. 2) and to close the passageway (FIG. 3)
Figure 3:
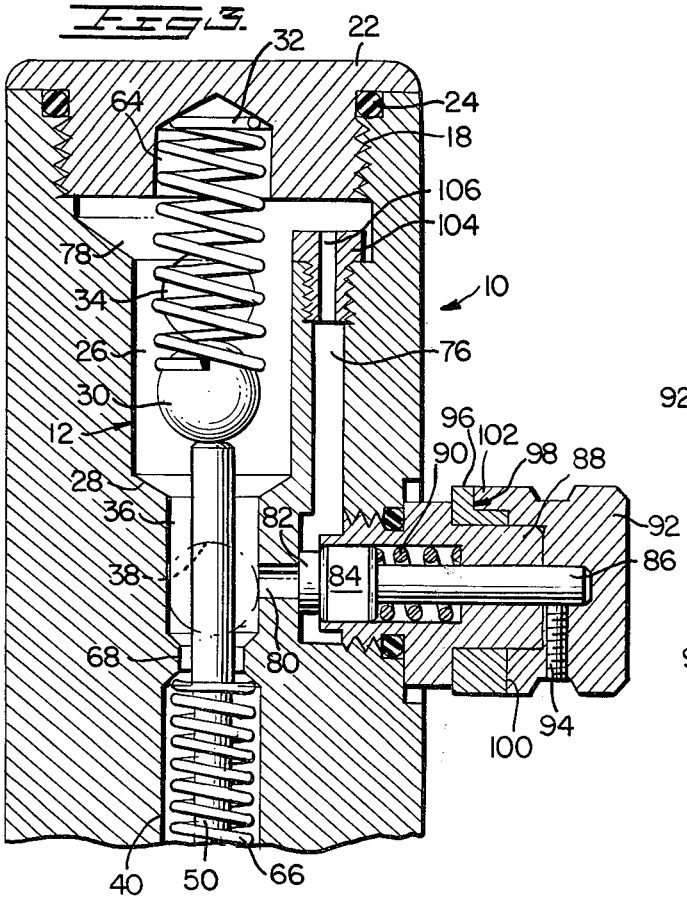
Figure 4:
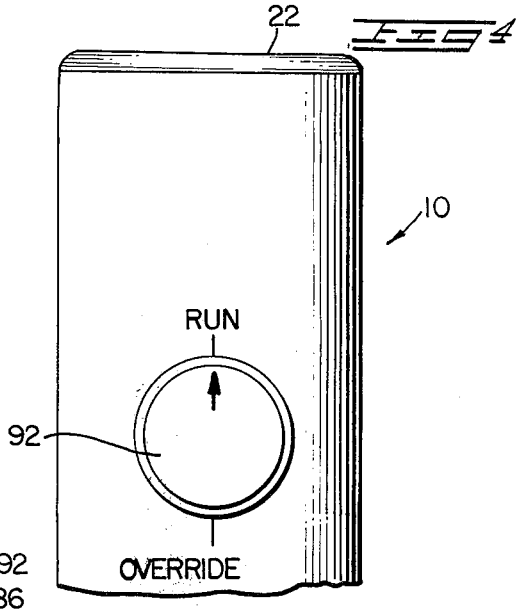
FIG. 4 is a fragmentary side elevation view of the device of FIGS. 1–3 showing the override control cap in normal engine running position.
Figure 5:
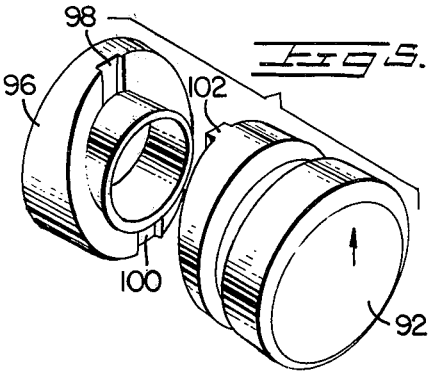
FIG. 5 is an exploded perspective view of the override control cap and associated stop member.

Referring now to the improvement provided by the present invention, as shown in FIGS. 2 and 3, the body 10 of the Oil Sentinel is provided with a vertical bore or passageway 76 which is parallel to and offset from the axis of the fuel intake and valve chamber 26 and fuel output chamber 36, and extends from the space 78, at the bottom of the enlarged counterbore into which cap 22 is threaded, downwardly to a point in substantially the same horizontal plane as the axis of fuel outlet port 38. At this point the lower end of passageway 76 joins a horizontal bore or passageway 80 which opens into fuel output chamber 36. Passageways 76 and 80 lie in a vertical plane which is perpendicular to the plane wherein inlet and outlet ports 34 and 38 are located.

As shown in FIG. 3, the outer end of passageway 80 is normally closed by a sealing member 82 mounted on the inner end of a piston 84 which is in turn connected to the inner end of a plunger 86 slidably mounted in an override body member 88 which is threaded into the body 10 of the Oil Sentinel. The plunger 86 is normally urged inwardly by a spring 90 housed in body 88 so as to bring sealing member 82 into engagement with the outer end of passageway 80, thereby preventing communication between passageways 76 and 80. Attached to the outer end of plunger 86 is a manually operable control cap 92 which is fixed to plunger 86 by a set screw 94 so that, by pulling outwardly on cap 92 and compressing spring 90, sealing member 82 may be withdrawn from and open the end of passageway 80, thereby providing a path for the passage of fuel from the space 78 via passageways 76 and 80 to the fuel outlet port 38.

Secured to override body 88 is an override stop member 96 which is provided with two machined stop surfaces 98 and 100 positioned 180° apart, the stop surface 100 being higher than the stop surface 98. Control cap 92 is provided with a flange or rim having a projection 102 which, in one rotational position of the cap, rests on the lower stop surface 98, at which time plunger 86 and piston 84 are moved inwardly by spring 90 so as to bring sealing member 82 into position to close the entrance to passageway 80. However, when cap 92 is manually pulled outwardly and then rotated through 180°, projection 102 comes to rest on the higher stop surface 100 so as to move sealing member 82 away from the end of passageway 80 and enable the flow of fuel from passageway 76 into passageway 80 and then through fuel outlet port 38 to the engine. In order to limit the quantity of fuel supplied to the engine when the ball valve 30 has closed due to a drop of oil pressure below the predetermined value, and control cap 92 is manually moved to the override position, opening communication between passageways 76 and 80, passageway 76 is provided with a replaceable fuel orifice fitting 104 which is threaded into the upper end of the passageway. The fitting 104 is provided with a fuel orifice 106 of restricted size which limits the amount of fuel that can flow to the engine from fuel inlet chamber 26 and space 78 via passageways 76 and 80 and fuel outlet chamber 40. In order to provide the restricted quantity of fuel that will produce the desired limited power and speed for any particular engine when the oil pressure has dropped below normal, or the engine has overheated, each Oil Sentinel may be supplied with a plurality of fuel orifice fittings 104 having fuel orifices of different diameters ranging, for example, from 0.010" up to 0.171". If the fuel orifice fitting 104 is removed and not replaced by one of a different sized orifice, there is a maximum 0.1875" passageway for the flow of override fuel.

There is thus provided by the present invention an improved device for controlling the supply of fuel to an internal combustion engine which provides, not only a full fuel shut-off effecting a full shut-down of the engine when abnormal pressure or temperature conditions arise, but also a restricted manual override which will supply only a limited amount of fuel to the engine after the main fuel valve has been automatically closed so that it may be operated at reduced power and speed.

What is claimed is:

1. In apparatus for controlling the flow of fuel to an internal combustion engine in response to pressure conditions existing in a pressure-lubricating system of the type comprising a body having a main fuel passageway therein, fuel inlet and outlet ports communicating with said passageway adapted to be connected to the fuel supply line of the engine, a valve in said passageway controlling the normal flow of fuel between said inlet and outlet ports, pressure-actuated means normally subject to a pressure equal to that of the lubricant in said lubricating system for maintaining said valve in open position as long as the pressure exerted on said means is at least equal to a predetermined value, and means operable to close said valve when the pressure exerted on said pressure-actuated means drops below said predetermined value, the improvement which comprises; manually operable means for supplying to said engine after said valve has closed automatically due to a drop in lubricant pressure a restricted amount of fuel sufficient only to run the engine at reduced power and reduced speed, said means comprising a bypass fuel passageway in said main body, bypassing the portion of said main passageway controlled by said valve, means for passing a predetermined restricted amount of fuel through said bypass passageway, an override body threaded into said main body adjacent a portion of said bypass passageway, a plunger including a sealing member slidably mounted in said override body, a spring in said override body normally urging said plunger and sealing member inwardly with respect to said main body so as to close said bypass passageway, a manually operable control cap fixed to said plunger for pulling said plunger and sealing member outwardly against the pressure of said spring and for rotating the plunger, an override stop member fixed to said override body having two stop surfaces of different heights circumferentially spaced from one another, and a projection on said control cap normally resting on the lower of said stop surfaces so that said spring urges said plunger and sealing member inwardly to close said bypass passageway, but adapted to rest on the higher of said stop surfaces and thereby open said bypass passageway when said plunger and sealing member are manually pulled outwardly and then rotated so as to move said projection from one stop surface to the other.

2. Apparatus as claimed in claim 1 wherein said means for passing a predetermined restricted amount of fuel through said bypass passageway comprises a replaceable fuel orifice fitting in said bypass passageway, the size of said orifice being selected to pass the predetermined restricted amount of fuel.

* * * * *